US007823594B2

(12) United States Patent
Defenbaugh et al.

(10) Patent No.: US 7,823,594 B2
(45) Date of Patent: Nov. 2, 2010

(54) FLEXIBLE SEAMLESS HAIR CLAMP

(75) Inventors: Michael Defenbaugh, Marietta, GA (US); Regina Hopper, Sylvania, OH (US); Allison Hardin, Smyma, GA (US)

(73) Assignee: Goody Products, Inc, Atlanta, GA (US)

( * ) Notice: Subject to any disclaimer, the term of this patent is extended or adjusted under 35 U.S.C. 154(b) by 195 days.

(21) Appl. No.: 11/833,812

(22) Filed: Aug. 3, 2007

(65) Prior Publication Data

US 2009/0032051 A1 Feb. 5, 2009

(51) Int. Cl.
*A45D 8/00* (2006.01)
*A45D 8/20* (2006.01)

(52) U.S. Cl. ..... 132/276; 132/273; 132/277

(58) Field of Classification Search ..... 132/273, 132/276–279, 281–284; 24/557
See application file for complete search history.

(56) References Cited

U.S. PATENT DOCUMENTS

| | | | | | |
|---|---|---|---|---|---|
| 34,990 | A | * | 4/1862 | Smith | 209/377 |
| 1,429,182 | A | * | 9/1922 | Ashley | 24/557 |
| 2,795,834 | A | * | 6/1957 | Szoke | 248/113 |
| 3,250,282 | A | * | 5/1966 | Thatcher | 132/277 |
| 3,842,849 | A | | 10/1974 | Goodman | |
| D269,156 | S | * | 5/1983 | Slinkard | D8/396 |
| 4,424,822 | A | * | 1/1984 | Wilborn, II | 132/277 |
| 5,520,201 | A | | 5/1996 | Hart et al. | |
| 6,142,159 | A | | 11/2000 | Lloyd | |
| 6,408,858 | B1 | * | 6/2002 | Emmons et al. | 132/247 |
| 6,681,778 | B1 | | 1/2004 | Salisbury et al. | 132/277 |
| D488,258 | S | * | 4/2004 | Walker et al. | D28/40 |
| 6,830,055 | B1 | | 12/2004 | Frame et al. | |
| D510,257 | S | * | 10/2005 | Marty et al. | D8/40 |
| 6,981,507 | B2 | | 1/2006 | Gabriele-Baumann | 132/275 |
| D536,132 | S | | 1/2007 | Vergona | D28/40 |
| 7,174,899 | B2 | | 2/2007 | Lane | 132/273 |
| 2002/0071718 | A1 | | 6/2002 | Marty et al. | |
| 2002/0162564 | A1 | | 11/2002 | Head et al. | 132/276 |
| 2004/0226574 | A1 | | 11/2004 | Winn et al. | 132/277 |
| 2004/0231692 | A1 | | 11/2004 | Shyu | 132/277 |
| 2006/0021631 | A1 | | 2/2006 | Lafauci | |
| 2006/0124149 | A1 | | 6/2006 | Salisbury et al. | 132/277 |
| 2006/0225763 | A1 | | 10/2006 | Lau | 132/277 |

FOREIGN PATENT DOCUMENTS

| | | |
|---|---|---|
| GB | 2325488 | 11/1998 |

* cited by examiner

*Primary Examiner*—Robyn Doan
(74) *Attorney, Agent, or Firm*—Gardner Groff Greenwald & Villanueva, PC

(57) ABSTRACT

This invention provides a flexible seamless hair clamp. More specifically, the flexible seamless hair clamp has a contiguous body portion. The contiguous body portion has a first leg member having a unitary first distal end and opposite thereto a first lever region, and a second leg member having a unitary second distal end and opposite thereto a second lever region. A curved bridging portion is disposed between and formed integrally with the first and second leg members proximate to the first and second lever regions. The bridging portion connects the first and second leg members in a manner such that each is oppositely juxtaposed with respect to each other and arranged to bias the distal ends into proximate contact with one another. Collectively, the first leg member, curved bridging portion and second leg member define a continuous concave surface within the contiguous body.

18 Claims, 5 Drawing Sheets

FLEXIBLE SEAMLESS HAIR CLAMP

FIELD

This invention relates generally to the field of hair clips and, in particular, to a flexible seamless hair clamp and method of use.

BACKGROUND

Hair clips are widely used devices to retain the hair of a wearer towards the back of the head. Traditional clips such as claw clips and the like, have a tendency to catch hair in the exposed coil spring and or hinge. As traditional hair clips are typically manufactured in such a way as to combine multiple separate and distinct parts, in addition to the spring and the hinge, there may be other structural elements that can potentially capture hair as well.

When the spring, hinge or other elements entrap hair, the caught hair is frequently pulled out of the wearer's head upon removal of the hair clip, a potentially painful and unpleasant experience for the wearer of the hair clip. Even if the hair is not pulled out, the caught hair may be cut, crimped or otherwise damaged. Such cutting, crimping or other damage can cause the hair to lie at an odd angle relative to the rest of the undamaged hair and therefore be unsightly.

In addition, as hair clips are generally composed of these multiple elements snapped or otherwise fit together, so as to maintain the proper alignment for interconnection, the hair clips typically are formed of hard plastic and metal, which results in rigid elements. As the wearer of a hair clip is often likely to be in a situation where his or her head is likely to contact a supporting surface, such as a head rest in a car, bus, plane, or other vehicle, the rigid structures can be quite painful to the wearer when the hair clip is itself caught between the wearer's head and a supporting surface.

The opportunity for discomfort when the hair clip is caught between the wearer's head and a supporting surface is further heightened by the fact that hair clips, such as claws, do not conform to the wearer's head. Barrettes generally do have a curved profile in an attempt to conform to the wearer's head, but as with claw clips, barrettes have exposed springs and hinge elements that frequently trap and/or damage hair. In addition, the metal and hard plastic elements of barrettes make them generally uncomfortable as well when caught between a wearer's head and a supporting surface.

Although some attempts have been made to cover the spring and hinge of a claw clip, these devices still maintain the rigid structures that may be painfully pressed into the wearer's head. The spring and hinge coverings may also be bulky and displeasing.

Hence, there is a need for a hair clip that overcomes one or more of the drawbacks identified above.

SUMMARY

This invention provides a flexible seamless hair clamp.

In particular, and by way of example only, according to an embodiment, provided is a flexible seamless hair clamp, including: a contiguous body portion having a first leg member having a unitary first distal end and opposite thereto a first lever region, and a second leg member having a unitary second distal end and opposite thereto a second lever region; a curved bridging portion disposed between and formed integrally with the first and second leg members proximate to the first and second lever regions, the bridging portion connecting the first and second leg members in a manner such that each is oppositely juxtaposed with respect to each other and arranged to bias the distal ends into proximate contact with one another; and the first leg member, curved bridging portion and second leg member defining a continuous concave surface within the contiguous body.

In accordance with an alternative embodiment, provided is a flexible seamless hair clamp, including: a curved first leg member having a unitary first distal end and opposite thereto a first lever region, the curved first leg member further having an inner surface; a curved second leg member having a unitary second distal end and opposite thereto a second lever region, the curved second leg member further having an inner surface; and a curved bridging portion seamlessly connecting the first leg member to the second leg member in facing opposition, the curved bridging portion disposed between the first and second leg members proximate to the first and second lever regions, the bridging portion having an inner surface and opposite thereto an outer surface, the inner surface facing the inner surface of the first leg member and the inner surface of the second leg member and providing a continuous hair friendly concave surface from the first distal end to the second distal end, the curved bridging portion biasing the first distal end and the second distal end into close proximate contact.

Further still, in accordance with yet another embodiment, provided is a flexible seamless hair clamp, including: a hair receiving aperture defined by a first continuous concave curved surface following a longitudinal centerline extending from a unitary first distal end through a midsection to a unitary second distal end; and a continuous outer surface opposite from the first continuous concave curved surface, the continuous outer surface and the first continuous curved surfaces provided by a compliant material with initial state memory, the initial state memory biasing the first distal end and the second distal end towards one another; and a pair of lever regions integral to the outer surface, the lever regions proximate to and on either side of the midsection opposite from the first and second distal ends.

DETAILED DESCRIPTION

Before proceeding with the detailed description, it is to be appreciated that the present teaching is by way of example, not by limitation. The concepts herein are not limited to use or application with a specific flexible seamless hair clamp and method of use. Thus, although the instrumentalities described herein are, for the convenience of explanation, shown and described with respect to exemplary embodiments, it will be appreciated that the principles herein may be equally applied in other types of flexible seamless hair clamps and/or methods of using a flexible seamless hair clamp.

Figure 1:
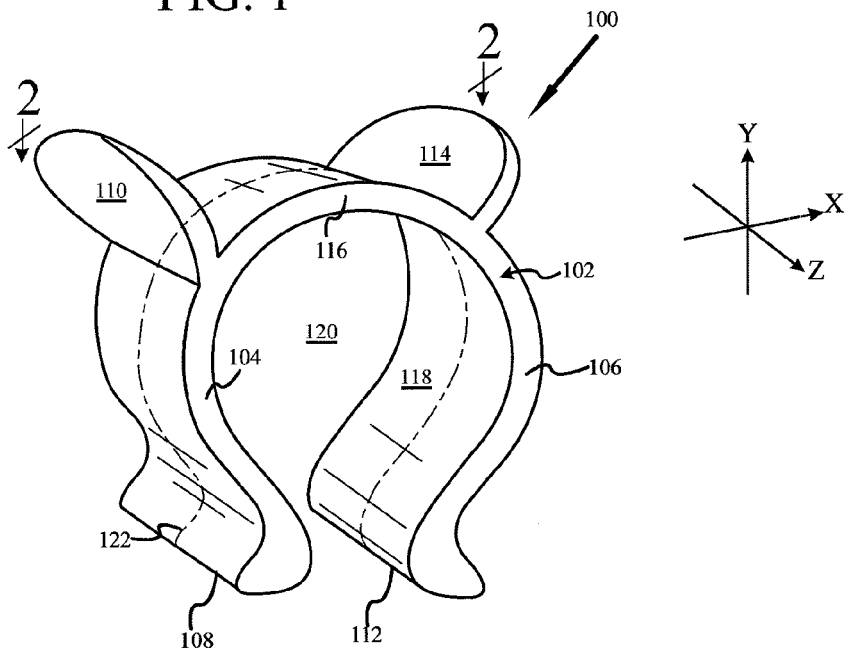
FIG. 1 is a perspective view of a flexible seamless hair clamp in accordance with at least one embodiment.

Turning now to the figures, and more specifically FIG. 1, there is shown a flexible seamless hair clamp 100 in accordance with at least one embodiment. To facilitate the description, the orientations are referenced to the coordinate system with three axes orthogonal to one another, as shown in FIG. 1. The axes intersect mutually at the origin of the coordinate system which is intended to be the center of the flexible seamless hair clamp 100. The axes shown in all figures are offset from their actual locations for clarity of illustration. Moreover, FIG. 1 is understood to be a perspective view of the flexible seamless hair clamp 100.

As shown in FIG. 1, flexible seamless hair clamp 100 has a contiguous body portion 102 having a first leg member 104 and a second leg member 106. The first leg member 104 has a unitary first distal end 108 and opposite thereto a first lever region 110. Similarly, the second leg member 106 has a unitary second distal end 112 and opposite thereto a second lever region 114. As shown, the unitary first and second distal ends 108, 112 are generally smooth and contiguous structures. Moreover, the first and second distal ends 108, 112 do not provide claws or mating teeth.

A curved bridging portion 116 is disposed between and formed integrally with the first and second leg members 104, 106 proximate to the first and second lever regions 110, 114. The curved bridging portion 116 seamlessly joins the first and second leg members 104, 106 such that each is oppositely juxtaposed with respect to each other. In addition, the curved bridging portion 116 biases the first distal end 108 and second distal end 112 into proximate contact.

With respect to FIG. 1 it is appreciated that the first leg member 104, curved bridging portion 116 and second leg member define a continuous concave surface 118 within the contiguous body 102. Flexible seamless hair clamp 100 may also be described as having a hair receiving aperture 120 defined by a continuous concave curved surface 118 following a longitudinal centerline 122 extending from the unitary first distal end 108 through the midsection, e.g. curved bridging portion 116, to the unitary second distal end 112.

Figure 2:
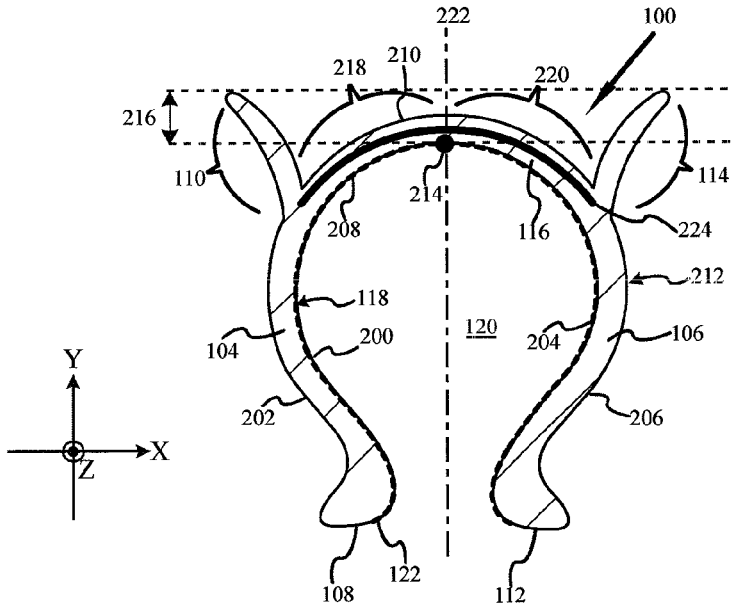
FIG. 2 is a side cut through view of the flexible seamless hair clamp shown in FIG. 1 in accordance with at least one embodiment.

FIG. 2 is a cut through view of the flexible seamless hair clamp 100, of FIG. 1 upon the YX plane. As a plane view, in FIG. 2 it may be easily appreciated that the first leg member 104 has an inner surface 200 and an outer surface 202. Likewise, the second leg member 106 has an inner surface 204 and an outer surface 206, and the curved bridging portion 116 has an inner surface 208 and an outer surface 210.

The inner surface 208 of the curved bridging portion 116 faces the inner surface 200 of the first leg member 104 and the inner surface 204 of the second leg member 106. Collectively, inner surfaces 200, 204 and 208 provide the continuous concave surface 118. It is also appreciated that the continuous concave surface 118 is a generally smooth hair friendly surface that does not have springs, seams, hinges or other protruding structures that might crimp, bind, cut or otherwise damage a user's hair.

Outer surfaces 202, 206 and 210 collectively provide continuous outer surface 212. The first lever region 110 and second lever region 114 are integral to the outer surface 212. It is also appreciated that portions of the first lever region 110 and the second lever region 114 extend above the highest point 214 of inner surface 208 of the curved bridge section, as indicated by dimension arrow 216. In at least one embodiment, flexible seamless hair clamp 100 is symmetrical. Specifically, the first leg member 104 and a first portion 218 of curved bridging portion 116 mirror the second leg member 106 and a second portion 220 of the curved bridging portion 116, with respect to central axis 222.

In addition, in at least one embodiment the point of biased proximate contact between the first distal end 108 and the second distal end 112 is symmetrically below the curved bridging portion. Moreover, in at least one embodiment, flexible seamless hair clamp 100 is appreciated to have a geometric shape generally of the Greek alphabet letter omega, e.g. Ω.

In at least one embodiment, the flexible seamless hair clamp 100 is formed through a process that provides a spring element 224 disposed within the curved bridging portion 116. In at least one embodiment, the spring element 224 is a plastic spring element, and even more specifically, a plastic leaf spring element. In at least one alternative embodiment, the spring element 224 is a metal spring element, and even more specifically, a metal leaf spring element. In certain embodiments, the use of a spring element 224 may be desired to assist in biasing the first distal end 108 into proximate contact with the second distal end 114. In at least one embodiment, the use of a plastic leaf spring element advantageously assists in biasing the first and second distal ends 108, 114 into contact while at the same time maintaining the generally soft and flexible properties of flexible seamless hair claim 100.

Figure 3:
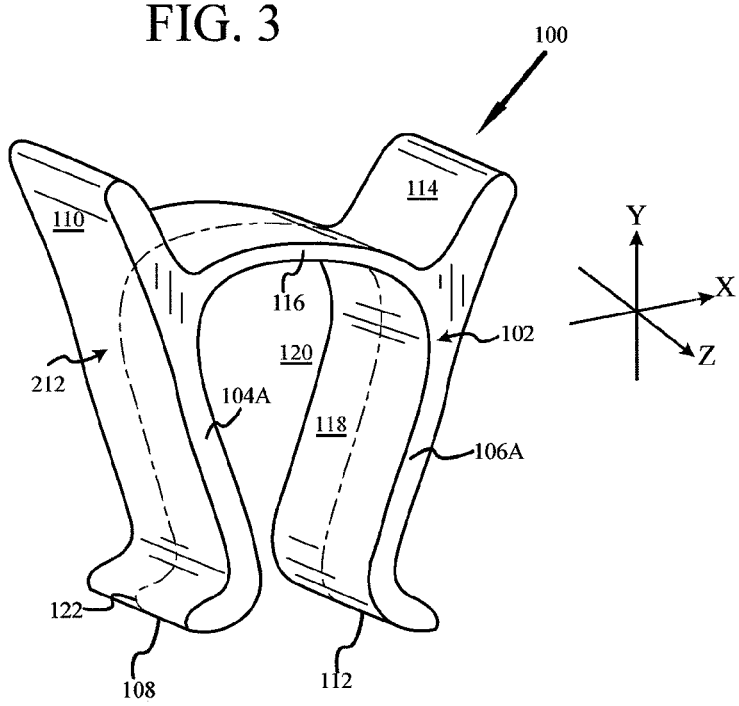
FIG. 3 is a flexible seamless hair clamp in accordance with at least one embodiment wherein the first and second leg members are not substantially curved.

FIG. 3 presents an alternative embodiment of flexible seamless hair clamp 100. Whereas in FIGS. 1 and 2, the first leg member 104 and second leg member 106 may be described as being curved, in FIG. 3 first leg member 104A and the second leg member 106A are generally straight. Moreover, it is understood and appreciated the first leg member 104 and second leg member 106 may be formed in a variety of shapes and configurations, however it is appreciated that the inner surface is a continuous concave surface 118.

Figure 4:
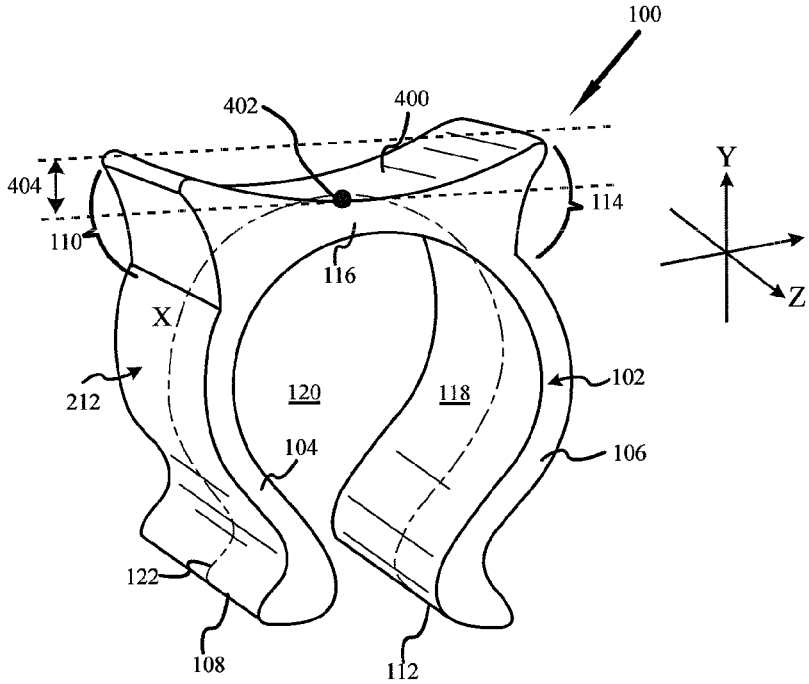
FIG. 4 is a flexible seamless hair clamp in accordance with at least one embodiment wherein the first and second lever regions are substantially integrated with the curved bridging portion.

FIG. 4 illustrates a perspective view of flexible seamless hair clamp 100 in accordance with yet another embodiment. Whereas in FIGS. 1-3 the first lever region 110 and the second lever region 114 are shown to physically extend as identifiable structures, in FIG. 4 the first leg member 104 and the curved bridging portion 116 blend together over the region that provides first lever region 110A. Likewise second leg member 106 and the curved bridging portion 116 blend together over the region that provides second lever region 114A. In such an embodiment, the outer surface 400 of the curved bridging section 116 is concave, such that portions of the first lever region 110A and second lever region 114A are above the midpoint 402 of outer surface 400, as indicated by dimension arrow 404.

Figure 5:
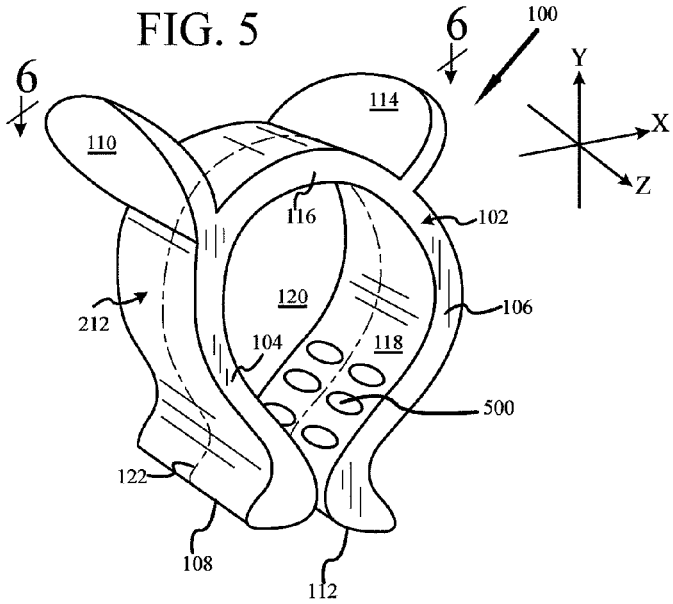
FIG. 5 is a flexible seamless hair clamp in accordance with at least one embodiment wherein the first and second unitary distal ends are in physical contact.
Figure 6:
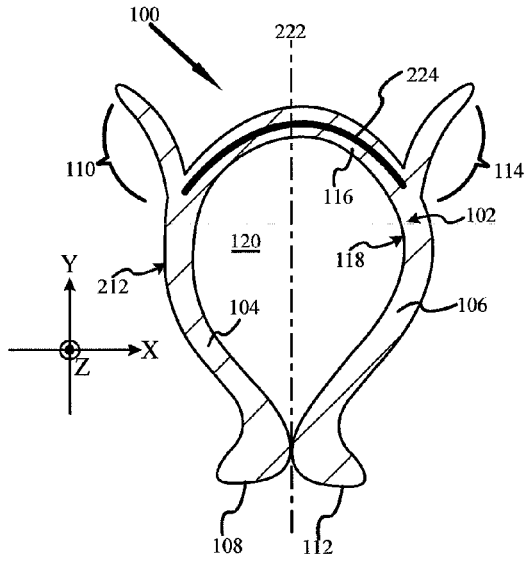
FIG. 6 is a side cut through view of the flexible seamless hair clamp shown in FIG. 5 in accordance with at least one embodiment.

Whereas in FIGS. 1~4 the first distal end 108 and second distal end 112 are shown in close, but physically separate, proximate contact, in FIG. 5, in accordance with an alternative embodiment the first distal end 108 and second distal end 112 are shown in actual physical contact. In addition, as shown in FIG. 5, in at least one embodiment, the internal contiguous concave surface may provide one or more areas 500 of hair gripping material. FIG. 6 is a cut through plane view of the flexible seamless hair clamp 100 shown in FIG. 5, further illustrating the physical contact between the first distal end 108 and the second distal end 112.

Figure 7:
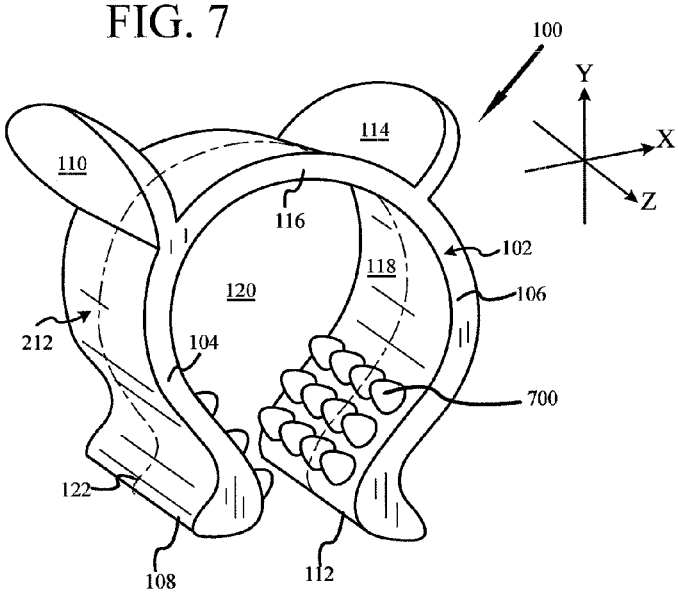
FIG. 7 is a flexible seamless hair clamp in accordance with at least one embodiment wherein a plurality of raised nubs are provided upon the internal continuous concave surface.

In an alternative embodiment, such as that shown in FIG. 7, a plurality of raised hair gripping nubs 700 may also be provided upon the continuous concave surface 118. It is understood and appreciated that gripping nubs 700, illustrated as cones for ease of illustration, may be ridges or other shapes. Moreover, gripping nubs 700 are structured and arranged to engage and grip a flexible seamless hair clamp 100 user's hair, but to do so in a manner that does not entangle, crimp or cut the hair as the gripping nubs 700 do not provide sharp.

As is illustrated in FIG. 2 by the hatching of the cross sectioned material, and indeed shown all of the accompanying figures, it is appreciated that the flexible seamless hair clamp 100 is provided as a continuous, unitary structure formed of flexible material. Moreover, in at least one embodiment the first leg member 104, curved bridging portion 116 and second leg member 106 comprise a contiguous unitary structure. In at least one embodiment, the flexible material providing flexible seamless hair clamp 100 is selected from the group consisting of plastic, natural rubber, polyurethane, resin and or combinations thereof. The use of materials that, when formed, have initial state memory is important.

The selected material is understood to have elastic flexibility such that when deformed under pressure it will return to it's initial state upon release of the pressure. Moreover, the curved bridging section 116 if not the entire contiguous body portion 102 is formed to have an initial state wherein the first distal end 108 and the second distal end 112 are biased to be in close proximate contact in at least one embodiment, if not actual physical contact in at least one alternative embodiment.

In at least one embodiment the flexible material used to form the flexible seamless hair clamp is nylon 6,6. Further, in at least one embodiment, a 60-70 durometer TPE overmold is applied to form at least a portion of continuous concave surface 118. In yet another embodiment, the raised nubs 700, areas 500 and or continuous concave surface 118 may be coated with a hair tacky material, such as TPE. It is understood and appreciated that the overmolding or coating is performed so as to avoid the generation of a hair catching edge or seam between the hair tacky material and the underlying material forming the contiguous body portion 102.

Flexible seamless hair clamp 100 is understood and appreciated to be a structure that is substantially seamless and free of seams, joints, or other structure that might unintentionally entrap and/or damage a user's hair. It is understood and appreciated that in varying embodiments, flexible seamless hair clamp 100 may be formed from various layers of materials that are seamlessly bonded together. For example, a material with a high coefficient of friction may be used to provide the continuous concave surface 118, or at least portions thereof (such as areas 500), and be seamlessly integrated with another material having a lower coefficient of friction that provides the outer surface of flexible seamless hair clamp 100. In such an embodiment, the inner continuous concave surface 118 will have a gripping tendency upon the user's hair while the outer surface will not.

FIGS. 1~7 show various embodiments of flexible seamless hair clamps 100 in an initial closed state. With respect to all of these figures and the varying embodiments, it is understood and appreciated that flexible seamless hair clamp 100 is a generally smooth hair friendly structure that does not have exposed springs, seams, hinges or other structures that might crimp, bind, cut or otherwise damage a user's hair. So as to contain and hold a user's hair, the flexible seamless hair clamp 100 is operable to move from an initial closed state to an open state, when it is then placed about a lock of hair, and release back to substantially the close state.

Figure 8:
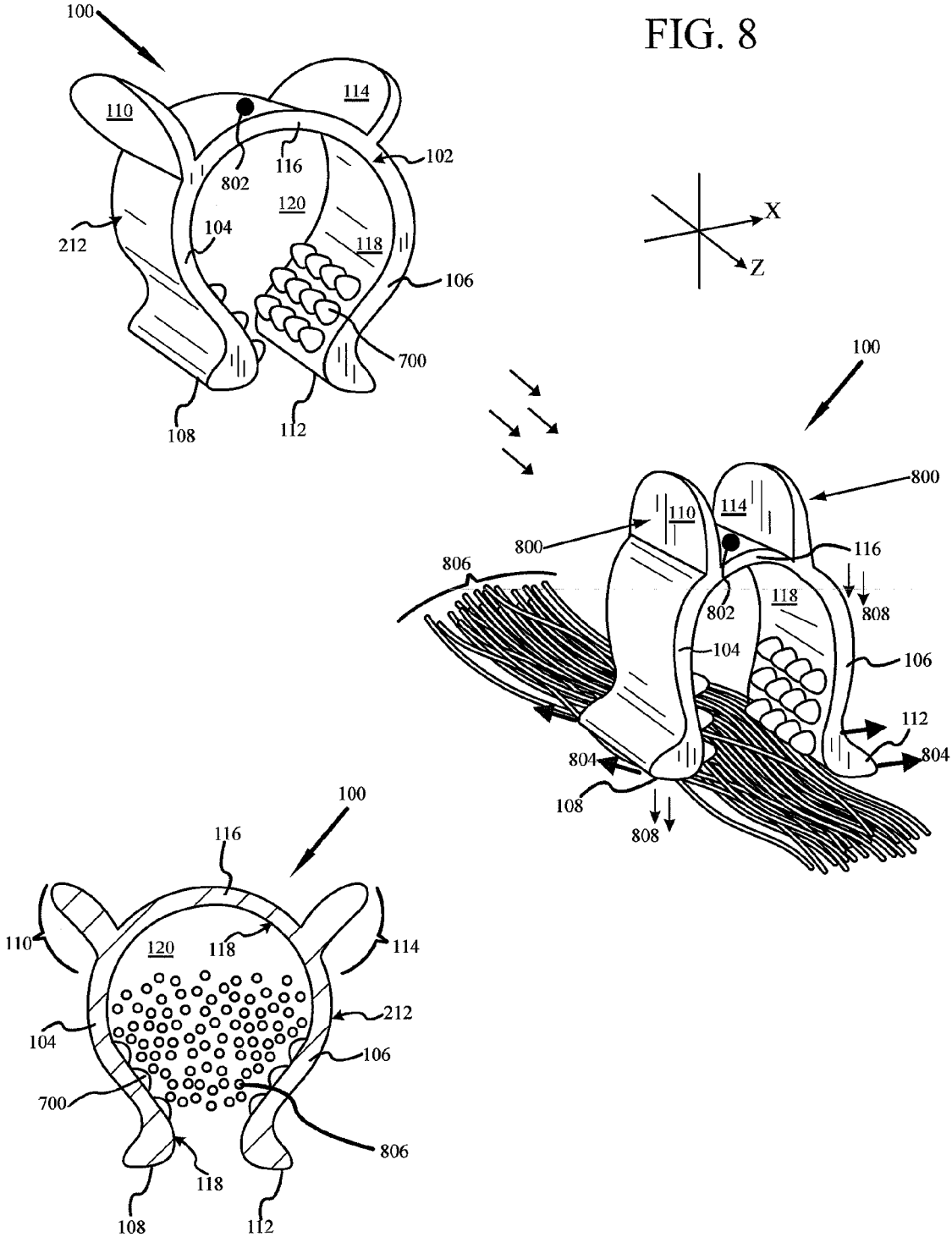
FIG. 8 illustrates a method of using the flexible seamless hair clamp in accordance with at least one embodiment.

FIG. 8 illustrates the process of opening the flexible seamless hair clamp 100. From the initial relaxed and closed state, opposing force is applied to first and second lever regions 110 and 112 as indicated by arrows 800. Operating as levers, this force imparts a tortion force about imaginary point 802 that is shown proximate to the midpoint of the curved bridging portion 116. As a result of this tortion force, as first and second lever regions 110 and 112 are moved towards one another above imaginary point 802, first distal end 108 and second distal end 112 are moved apart, as indicated by arrows 804.

With first and second distal ends 108, 112 now disposed apart, the hair receiving aperture is provided in a ready state to receive a lock of the user's hair, 806. More specifically, while maintaining force 800 upon the first and second lever regions 110, 112 the flexible seamless hair clamp 100 is placed over a lock of hair as indicated by arrows 808. With the flexible seamless hair clamp 100 then in place, force 800 is released the biasing tendency of curved bridging section 116 returns the first and second distal ends 108, 112 to their sate of proximate contact.

As the separation force parting the first and second distal ends 108, 112 is applied by the user to the first and second lever regions 110, 114 the user of flexible hair clamp 100 advantageously avoids the need to place his or her fingers between the first and second distal ends 108, 112. In addition, as force 800 is a compressive force, it is likely that the user may apply flexible seamless hair clamp 100 about his or her hair using only one hand. Specifically the thumb and forefingers may be applied respectively to the first lever region 100 and the second lever region 114, with the thumb and forefinger then being pinched together. Removal of the flexible seamless hair clamp 100 may also be performed in an advantageous one handed manner.

Figure 9:
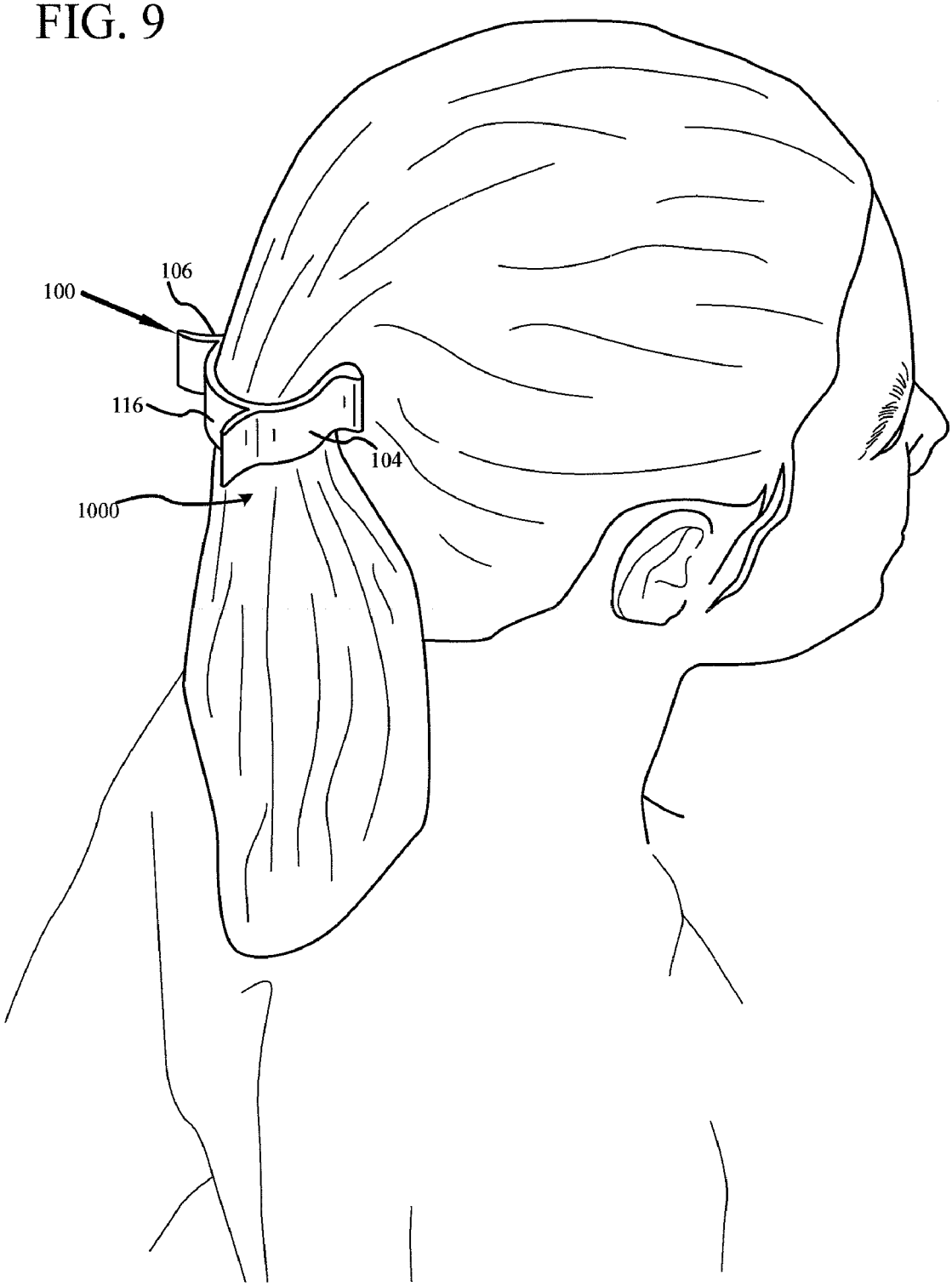
FIG. 9 is a perspective view of the flexible seamless hair claim in place to temporarily bind a user's hair.

FIG. 9 is a perspective view of the flexible seamless hair clamp 100 engaged about a wearer's hair 900. It is understood and appreciated that a locking clasp, snapping clip, or other engaging device is advantageously not employed to maintain the flexible seamless hair clamp 100 in a closed and engaged position.

The absence of such a locking mechanism or device eliminates the opportunity to damage a user's hair. Indeed, the user's hair to be temporarily bound is encompassed by the continuous concave surface 118 without crimping or cutting damage being imposed upon the hair, and the flexible seamless hair clamp 100 will remain closed. In addition, in many instances the wearing user may bring his or her head against a surface proximate to if not directly upon the area of the head where the flexible seamless hair clamp 100 has been placed to temporarily bind the hair. As flexible seamless hair clamp 100 is entirely flexible, flexible seamless hair clamp 100 may distort under pressure without breaking or opening. Further, if the flexible seamless hair clamp 100 is indeed caught between the user's head and a supporting surface, ridged elements will not be pressed against the user's head, an action that could result in discomfort if not outright pain.

Moreover, the curved bridging portion 116 if not the entire contiguous body portion 102 is formed to have an initial state wherein the first distal end 108 and the second distal end 112 are biased to be in close proximate contact in at least one embodiment, if not actual physical contact in at least one alternative embodiment.

Changes may be made in the above methods, systems, processes and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. A flexible seamless hair clamp, comprising:

a seamless continuous one-piece body having a curved seamless continuous first leg member, a curved seamless continuous second leg member, and a curved seamless continuous bridging portion and an elongate spring element disposed entirely within the curved bridge portion;

the curved seamless continuous first leg member having a curved seamless continuous first clip portion and extending seamlessly therefrom and opposite thereto a seamless continuous first lever region, the first clip portion defining an inner surface and including a unitary first distal end;

the curved seamless continuous second leg member having a curved seamless continuous second clip portion and extending seamlessly therefrom and opposite thereto a seamless continuous second lever region, the second clip portion defining an inner surface and including a unitary second distal end; and the curved seamless continuous bridging portion seamlessly connecting the first leg member to the second leg member in facing opposition, the curved bridging portion disposed between the first and second leg members proximate to the first and second lever regions, the bridging portion having an inner surface and opposite thereto an outer surface, the inner surface of the bridging portion facing the inner surface of the first leg member and the inner surface of the second leg member, the inner surfaces of the bridging portion and the first and second leg members collectively defining a seamless continuous hair-friendly concave surface from the first distal end to the second distal end without any claws or teeth formed by the clip portions and without any portions of the leg members folded back onto themselves to form the lever regions such that the first and second leg members are of a single-wall construction, the curved bridging portion biasing the first distal end and the second distal end into close proximity, wherein the hair clamp is operable to move from an initial closed state to an open state when opposing compression force is applied to the first lever region and the second lever region by two fingers of the same hand in a one-handed operation, the force imparting a torsional rotation of the first leg member and the second leg member about an imaginary point proximate to the center of the curved bridging portion, the rotation of the first leg member and the second leg member separating the first distal end and the second distal end from their initial proximity, wherein the body is made of a resilient flexible material and the bridging portion is elongate such that it biases the distal ends of the leg members toward each other and flexes to a less concave shape when the opposing compression force is applied to the lever regions.

2. The flexible seamless hair clamp of claim 1, wherein the first leg member, the second leg member and the curved bridging portion are formed from materials selected from the group consisting of elastic resin, plastic, natural rubber, polyurethane, and combinations thereof.

3. The flexible seamless hair clamp of claim 1, wherein the first leg member, the second leg member, and the curved bridging portion together a geometric shape generally of the Greek alphabet letter omega.

4. The flexible seamless hair clamp of claim 1, wherein the unitary hair clamp has elastic memory for the initial closed state.

5. The flexible seamless hair clamp of claim 1, wherein the hair clamp is symmetrical.

6. The flexible seamless hair clamp of claim 1, wherein the hair-friendly concave surface provides a plurality of raised gripping nubs.

7. The flexible seamless hair clamp of claim 1, wherein the unitary hair clamp has elastic memory for an initial closed state.

8. The flexible seamless hair clamp of claim 1, wherein such that when the first lever region and second lever regions are forced towards one another about the curved bridging portion, the first distal end and second distal end are separated.

9. The flexible seamless hair clamp of claim 1, wherein the first distal end and the second distal end are biased into actual physical contact.

10. The flexible seamless hair clamp of claim 1, wherein the elongate spring element extends along the bridging portion all the way between the leg members, but not along the leg members.

11. A flexible seamless hair clamp, comprising:

a seamless continuous one-piece body having a curved seamless continuous first leg member, a curved seamless continuous second leg member, and a curved seamless continuous bridging portion; and an elongate spring element disposed entirely within the curved bridging portion, wherein the elongate spring element extends along the bridging portion all the way between the leg members, but not along the leg members;

the curved seamless continuous first leg member having a curved seamless continuous first clip portion and extending seamlessly therefrom and opposite thereto a seamless continuous first lever region, the first clip portion defining an inner surface and including a unitary first distal end;

the curved seamless continuous second leg member having a curved seamless continuous second clip portion and extending seamlessly therefrom and opposite thereto a seamless continuous second lever region, the second clip portion defining an inner surface and including a unitary second distal end; and the curved seamless continuous bridging portion seamlessly connecting the first leg member to the second leg member in facing opposition, the curved bridging portion disposed between the first and second leg members proximate to the first and second lever regions, the bridging portion having an inner surface and opposite thereto an outer surface, the inner surface of the bridging portion facing the inner surface of the first leg member and the inner surface of the second leg member, the inner surfaces of the bridging portion and the first and second leg members collectively defining a seamless continuous hair-friendly concave surface from the first distal end to the second distal end without any claws or teeth formed by the clip portions and without any portions of the leg members folded back onto themselves to form the lever regions such that the first and second leg members are of a single-wall construction, the curved bridging portion biasing the first distal end and the second distal end into close proximity, wherein the hair clamp is operable to move from an initial closed state to an open state when opposing compression force is applied to the first lever region and the second lever region by two fingers of the same hand in a one-handed operation, the force imparting a torsional rotation of the first leg member and the second leg member about an imaginary point proximate to the center of the curved bridging portion, the rotation of the first leg member and the second leg member separating the first distal end and the second distal end from their initial proximity, the unitary hair clamp having elastic memory for the initial closed state, wherein the body is made of a resilient flexible material and the bridging portion is elongate such that it biases the distal ends of the leg members toward each other and flexes to a less concave shape when the opposing compression force is applied to the lever regions, wherein the body is formed from one or more materials selected from the group consisting of elastic resin, plastic, natural rubber, polyurethane, and combinations thereof.

12. The flexible seamless hair clamp of claim 11, wherein the hair-friendly concave surface provides a plurality of raised gripping nubs.

13. The flexible seamless hair clamp of claim 11, wherein the first distal end and the second distal end are biased into physical contact in the initial closed position, and wherein when the first lever region and second lever regions are forced towards one another about the curved bridging portion, the first distal end and second distal end are separated from physical contact.

14. The flexible seamless hair clamp of claim 11, wherein the first leg member, the second leg member, and the curved bridging portion together a geometric shape generally of the Greek alphabet letter omega.

15. The flexible seamless hair clamp of claim 11, wherein the hair clamp is symmetrical.

16. The flexible seamless hair clamp of claim 11, wherein the first leg member, the second leg member, and the bridging portion of the body have a substantially uniform thickness.

17. The flexible seamless hair clamp of claim 11, wherein the first lever region and the second lever region have free ends that are tapered.

18. A flexible seamless hair clamp, consisting of:

a seamless continuous one-piece body having a curved seamless continuous first leg member, a curved seamless continuous second leg member, and a curved seamless continuous bridging portion; and an elongate spring element disposed entirely within the curved bridging portion, wherein the elongate spring element extends along the bridging portion all the way between the leg members, but not along the leg members;

the curved seamless continuous first leg member having a curved seamless continuous first clip portion and extending seamlessly therefrom and opposite thereto a seamless continuous first lever region, the first clip portion defining an inner surface and including a unitary first distal end;

the curved seamless continuous second leg member having a curved seamless continuous second clip portion and extending seamlessly therefrom and opposite thereto a seamless continuous second lever region, the second clip portion defining an inner surface and including a unitary second distal end; and the curved seamless continuous bridging portion seamlessly connecting the first leg member to the second leg member in facing opposition, the curved bridging portion disposed between the first and second leg members proximate to the first and second lever regions, the bridging portion having an inner surface and opposite thereto an outer surface, the inner surface of the bridging portion facing the inner surface of the first leg member and the inner surface of the second leg member, the inner surfaces of the bridging portion and the first and second leg members collectively defining a seamless continuous hair-friendly concave surface from the first distal end to the second distal end without any claws or teeth formed by the clip portions and without any portions of the leg members folded back onto themselves to form the lever regions such that the first and second leg members are of a single-wall construction, the curved bridging portion biasing the first distal end and the second distal end into close proximity, wherein the hair clamp is operable to move from an initial closed state to an open state when opposing compression force is applied to the first lever region and the second lever region by two fingers of the same hand in a one-handed operation, the force imparting a torsional rotation of the first leg member and the second leg member about an imaginary point proximate to the center of the curved bridging portion, the rotation of the first leg member and the second leg member separating the first distal end and the second distal end from their initial proximity, the unitary hair clamp having elastic memory for the initial closed state, wherein the body is made of a resilient flexible material and the bridging portion is elongate such that it biases the distal ends of the leg members toward each other and flexes to a less concave shape when the opposing compression force is applied to the lever regions, wherein the body is formed from one or more materials selected from the group consisting of elastic resin, plastic, natural rubber, polyurethane, and combinations thereof.

* * * * *